US006304070B1

(12) United States Patent
Hirabayashi

(10) Patent No.: US 6,304,070 B1
(45) Date of Patent: Oct. 16, 2001

(54) VOLTAGE/CURRENT CONVERTER CIRCUIT AND HIGH-GAIN AMPLIFYING CIRCUIT

(75) Inventor: Atsushi Hirabayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/620,159

(22) Filed: Jul. 20, 2000

(30) Foreign Application Priority Data

Jul. 23, 1999 (JP) ..... 11-209389

(51) Int. Cl.[7] ..... G05F 3/20

(52) U.S. Cl. ..... 323/313; 323/316; 363/73; 330/252

(58) Field of Search ..... 323/313, 314, 323/315, 316; 363/73; 330/252, 254, 257

(56) References Cited

U.S. PATENT DOCUMENTS 4,243,948 * 1/1981 Schade, Jr. ..... 323/316
4,795,961 * 1/1989 Neidorff ..... 323/314
5,004,938 * 4/1991 Lee ..... 323/316 X
5,144,223 * 9/1992 Gillingham ..... 323/313

* cited by examiner

*Primary Examiner*—Jessica Han
(74) *Attorney, Agent, or Firm*—Frommer Lawrence & Haug LLP.; William S. Frommer

(57) ABSTRACT

A voltage/current converter circuit includes a first differential pair circuit containing a first pair of MOS transistors, a second differential pair circuit containing a second pair of MOS transistors wherein the drain terminals thereof are connected to each of the source terminals of the first MOS transistor differential pair circuit, and a resistor element connected between the sources of the second MOS transistor differential pair circuit, wherein the gates of the second pair of MOS transistors are mutually connected to the drains of the MOS transistors of the other side, and the sources of the two MOS transistors are each grounded via an electric current source. Thus, a high-gain amplifier with improved linearity is realized with a small number of elements, thereby reducing electric power consumption and reduced IC chip surface area.

4 Claims, 6 Drawing Sheets

VOLTAGE/CURRENT CONVERTER CIRCUIT AND HIGH-GAIN AMPLIFYING CIRCUIT

BACKGROUND OF THE INVENTION

1. Field of the invention

The present invention relates to a voltage/current converter circuit and a high-gain amplifying circuit, and particularly relates to a voltage/current converter circuit and a high-gain amplifying circuit wherein a high-gain amplifying circuit with improved linearity is realized by using MOS transistor differential pair circuits.

2. Description of the Related Art

Conventionally, in conjunction with increased speed of communication devices and data recording devices, high gain and improved linearity of amplifiers has been required.

FIG. 5 is a circuit diagram illustrating the circuit configuration of a conventional voltage/current converter circuit containing a MOS transistor differential pair circuit.

With the voltage/current converter circuit containing a conventional MOS transistor differential pair circuit shown in FIG. 5, the drain currents $I_1$ and $I_2$ are obtained by a later-described Expression (1).

Accordingly, with conventional voltage/current converter circuits, the action properties graph indicating the voltage/current conversion ratio thereof has exhibited a very narrow range where linearity is good.

Accordingly, a method for expanding the dynamic range by inserting a resistor between the sources of the MOS transistor differential pair has been conceived as means for securing the necessary linearity.

However, the above conventional method has adverse effects in that the conductance and gain of the amplifier are lowered. Accordingly, various methods for increasing linearity without inserting a resistor between the sources of the MOS transistor differential pair have been proposed.

FIG. 6 is a circuit diagram illustrating the circuit configuration of a conventional voltage/current converter circuit containing a MOS transistor differential pair circuit intending improved linearity.

The circuit shown in FIG. 6 realizes output current of $i=I_1-I_2$ using a current mirror circuit, thus allowing the output current to be accurately proportionate to the input voltage.

However, with the conventional art, an N-MOS and P-MOS are used in junction as circuit components as can be understood from the voltage/current converter circuit shown in FIG. 6, so the power source voltage must be set high. Further, the output thereof is single output, which leads to the output current leaking to other circuits, consequently having markedly adverse effects on circuit operation.

As can be understood from the above examples, attempting to secure linearity with conventional voltage/current converter circuits using MOS transistor differential pair circuits results in high gain being unobtainable, and a differential output configuration cannot be used so the output current leaks to other circuits or circuit components. This has been a hindrance in advancement in application of high-frequency linear circuits with MOS transistors.

SUMMARY OF THE INVENTION

The present invention has been made in light of the above problems in conventional voltage/current converter circuits, and accordingly, it is an object of the present invention to realize a high-gain amplifier with improved linearity with fewer elements, and to provide a voltage/current converter circuit and high-gain amplifying circuit capable of realizing reduced electric power consumption and reduced IC chip surface area.

In order to solve the above problems, the present invention provides a voltage/current converter circuit, comprising a first MOS transistor differential pair circuit, a second MOS transistor differential pair circuit wherein the drain terminal thereof are connected to each of the source terminals of the first MOS transistor differential pair circuit, and a resistor element connected between the sources of the second MOS transistor differential pair circuit, wherein the gate terminals of the first MOS transistor differential pair circuit serve as input voltage terminals and the drain terminals serve as output current terminals, and wherein the gates of the two mutually complementary MOS transistors of the second MOS transistor differential pair circuit are mutually connected to the drains of the MOS transistors of the other side, and the sources of the two MOS transistors are each grounded via an electric current source.

Also, in order to solve the above problems, the present invention provides a voltage/current converter circuit, comprising a first MOS transistor differential pair circuit, and a second MOS transistor differential pair circuit wherein the drain terminal thereof are connected to each of the source terminals of the first MOS transistor differential pair circuit, and wherein the gate terminals of the first MOS transistor differential pair circuit serve as input voltage terminals and the drain terminals serve as output current terminals, and wherein the gates of the two mutually complementary MOS transistors of the second MOS transistor differential pair circuit are mutually connected to the drains of the MOS transistors of the other side, and the sources of the two MOS transistors are each grounded via a resistor element.

Also, in order to solve the above problems, the present invention provides a high-gain amplifying circuit, comprising a first MOS transistor differential pair circuit, a second MOS transistor differential pair circuit wherein the drain terminal thereof are connected to each of the source terminals of the first MOS transistor differential pair circuit via first resistor elements, second resistor elements connected between the sources of the second MOS transistor differential pair circuit, and impedance elements connected between the drains of the second MOS transistor differential pair circuit, wherein the gate terminals of the first MOS transistor differential pair circuit serve as input voltage terminals and the drain terminals serve as output current terminals, and wherein the gates of the two mutually complementary MOS transistors of the second MOS transistor differential pair circuit are mutually connected to the drains of the MOS transistors of the other side, and the sources of the two MOS transistors are each grounded via an electric current source.

Further, in order to solve the above problems, the present invention provides a high-gain amplifying circuit, comprising a first MOS transistor differential pair circuit, a second MOS transistor differential pair circuit wherein the drain terminal thereof are connected to each of the source terminals of the first MOS transistor differential pair circuit via first resistor elements, and impedance elements connected between the drains of the second MOS transistor differential pair circuit, wherein the gate terminals of the first MOS transistor differential pair circuit serve as input voltage terminals and the drain terminals serve as output current terminals, and wherein the gates of the two mutually complementary MOS transistors of the second MOS transistor differential pair circuit are mutually connected to the drains of the MOS transistors of the other side, and the sources of the two MOS transistors are each grounded via second resistor elements.

That is to say, the present invention first comprises a submissively-connected first MOS transistor differential pair circuit and second MOS transistor differential pair circuit, i.e., two MOS transistor differential pair circuits, wherein the gates of the second MOS transistor differential pair circuit are mutually connected to the drains of the transistor on the other side, a resistor is connected between the sources of the second MOS transistor differential pair circuit, and differential signal input is input between the gates of the first MOS transistor differential pair circuit, thereby providing a voltage/current converter circuit for extracting output current from drain terminals, and an equivalent circuit thereof.

Next, of the submissively-connected first MOS transistor differential pair circuit and second MOS transistor differential pair circuit, i.e., the two MOS transistor differential pair circuits, first resistors are connected between the sources of the first MOS transistor differential pair circuit and the drains of the second MOS transistor differential pair circuit, and also a negative impedance feedback circuit wherein the gates of the second MOS transistor differential pair circuit are mutually connected to the drains of the transistor at the other side, so that the conductance of the second MOS transistor differential pair circuit is fed back as negative conductance to the first MOS transistor differential pair circuit, and also wherein a second resistor is connected between the sources of the second MOS transistor differential pair circuit, thereby providing a high-gain amplifying circuit and the equivalency circuit thereof wherein differential signal input is input between the gates of the first MOS transistor differential pair circuit.

In the above high-gain amplifying circuit, the conductance and a conductance which has equal size as the conductance but opposite polarity mutually cancel out each other, thereby allowing conductance which is far greater than the conventional to be made, thus realizing a high-gain amplifying circuit with lower electric power consumption.

Accordingly, the target high gain can be obtained with a fewer number of elements as compared to conventional arrangements, and the capabilities of the circuit such as the S-N ration can be improved.

Also, making the ratio between the positive conductance and negative conductance to be appropriate realizes a voltage/current converter circuit which has suitable linearity with a fewer number of elements as compared to conventional arrangements.

Further, the configuration is only a single-channel configuration, so there is no need to take the matching between P-channel and N-channel into consideration, which reduces irregularity causes in the circuit accordingly, thereby improving freedom in design and advantages in low-voltage operation.

Consequently, a high-gain amplifying circuit sufficiently capable of dealing with low-voltage operation and providing suitable linearity with a fewer number of elements can be realizing, and further, lower electric power consumption and reduction in IC chip surface area can be anticipated, thereby enabling marked reductions in IC costs and manufacturing costs.

DETAILED DESCRIPTION OF THE PREFERRED EMBODIMENT

An embodiment of the present invention will now be described with reference to the drawings.

Figure 1:
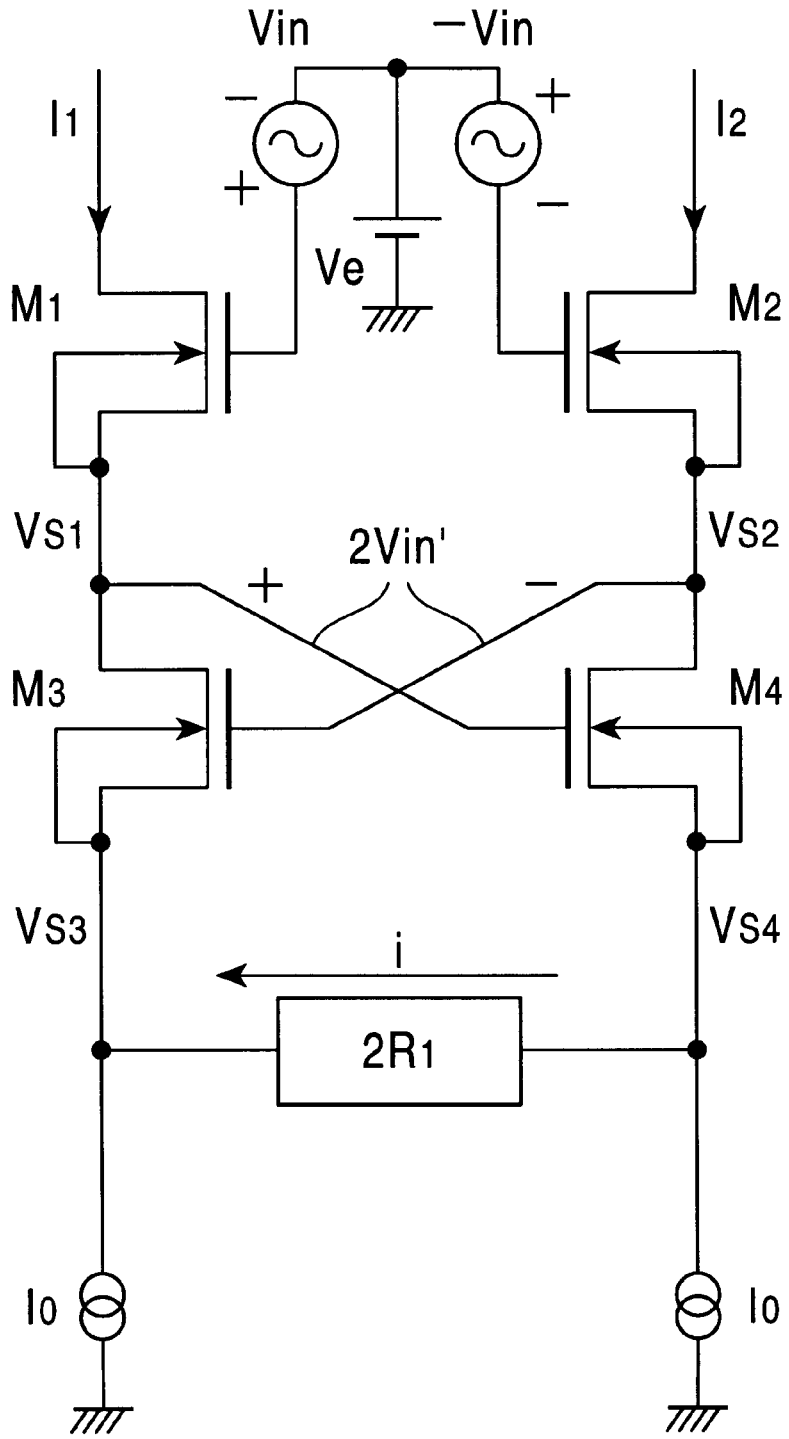
FIG. 1 is a circuit diagram illustrating the circuit configuration of the voltage/current converter circuit according to an embodiment of the present invention.

FIG. 1 is a circuit diagram illustrating the circuit configuration of the voltage/current converter circuit according to an embodiment of the present invention.

The voltage/current converter circuit according to the present embodiment has MOS transistors $M_1$ and $M_2$ contained in a first MOS transistor differential pair circuit (hereafter referred to as "MOS differential pair"), MOS transistors $M_3$ and $M_4$ making up a second MOS differential pair, and a resistor ($2R_1$) connected between the sources of the second MOS differential pair.

The gates of the MOS transistors $M_1$ and $M_2$ are subjected to application of Vin and −Vin, respectively. The source of the MOS transistor $M_1$ is connected to the drain of the MOS transistor $M_3$, and the source of the MOS transistor $M_2$ is connected to the drain of the MOS transistor $M_4$. Also, the gate of the MOS transistor $M_3$ is connected to the drain of the MOS transistor $M_4$, and the gate of the MOS transistor $M_4$ is connected to the drain of the MOS transistor $M_3$.

The resistor ($2R_1$) is connected between the sources of the MOS transistors $M_3$ and $M_4$. The source of the MOS transistor $M_3$ is grounded via a DC electric current source $I_0$, and the source of the MOS transistor $M_4$ is also grounded via the same electric current source $I_0$.

The following is a description of the operation of the voltage/current converter circuit relating to the present embodiment.

Let is say that the drain current coefficients and thresholds of the MOS transistors $M_1$, $M_2$, $M_3$, and $M_4$ are all the same, M and Vth respectively. Also, the back gate of each MOS transistor is connected to the source of the same MOS transistor, so that the threshold Vth is equal.

Generally, drain current in the saturation area is the voltage Vgs between the gate and source of the MOS transistors $M_1$ and $M_3$ to the second power as shown in the later-described Expression (2), wherein the rate of rise accompanied by increase in Vds following the pinch-off voltage of the drain current of the transistor (i.e., the early coefficient of the drain current in the saturation area) is represented by $\lambda$. This has been the greatest hindrance in linear operation of MOS transistors.

The above drain current is proportionate to Vgs to the second power, so it is clear that finding some way to convert this to an expression proportionate to Vgs to the first power will lead to improvement in linearity.

Accordingly, firstly noticeable is an expression such as the later-described Expression (3). With a MOS differential pair having a common source, let us apply an expression such as the later-described Expression (3) with X=Ve+Vin and Y=Ve−Vin, and further the potential at the common source as Vs. At the same time, substituting Expression (2) wherein the threshold of the MOS transistor is represented by Vth into the later-described Expression (3) expresses the difference between the drain current $I_1$ and $I_2$ as the primary function of Vin, as shown in Expression (4).

Figure 6:
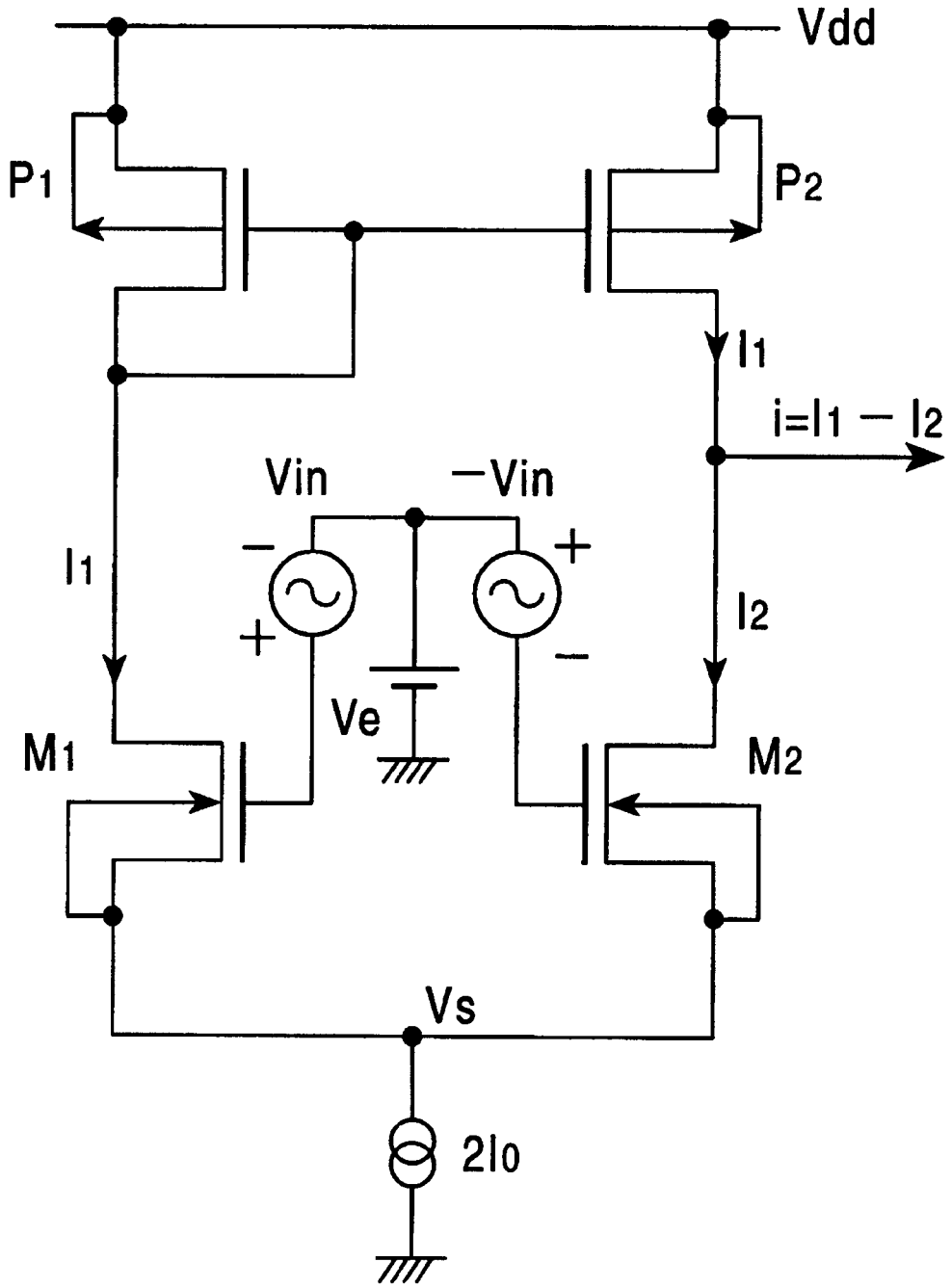
FIG. 6 (PRIOR ART)
FIG. 6 is a circuit diagram illustrating the circuit configuration of a conventional voltage/current converter circuit containing a MOS transistor differential pair circuit intending improved linearity.

Accordingly, what is necessary is to create the difference between drain currents $I_1$ and $I_2$ (i.e., $I_1-I_2$) by circuit. conventionally, this has been accomplished by in using a current mirror circuit, as shown in the aforementioned FIG. 6.

As can be understood from the aforementioned FIG. 6, there is the need to use an N-MOS and P-MOS in conjunction with the method using the current mirror circuit, and the output thereof is single, so this encourages increase in the power source voltage, and further the input signals cannot be used as differential signals, which has been the cause of adverse effects on the entire circuit, such as increase in frequency and also cross-talk.

However, the method for creating the difference between the drain currents $I_1$ and $I_2$ is an effective means for improving the linearity of the circuit, and an arrangement wherein this is realized with another method is the circuit shown in FIG. 1.

As described later, solving the expressions in sequence with the rate of rise accompanied by increase in Vds following the pinch-off voltage of the drain current of all transistors (i.e., the early coefficient of the drain current in the saturation area) being represented by λ, and assuming that there is no leakage current to other than the transistors, yields $Vin=i\times R_1$, as shown in Expression 7. Accordingly, the output current of the differential V/I converter circuit configured of the MOS transistors $M_1$, $M_2$, $M_3$, and $M_4$, and resistor ($2R_1$) has linear properties proportionate to the input voltage Vin, as shown in Expression (8). In this way, it has been shown here that a voltage/current converter circuit which realizes improved linearity can be realized using only N-MOS transistors.

Figure 2:
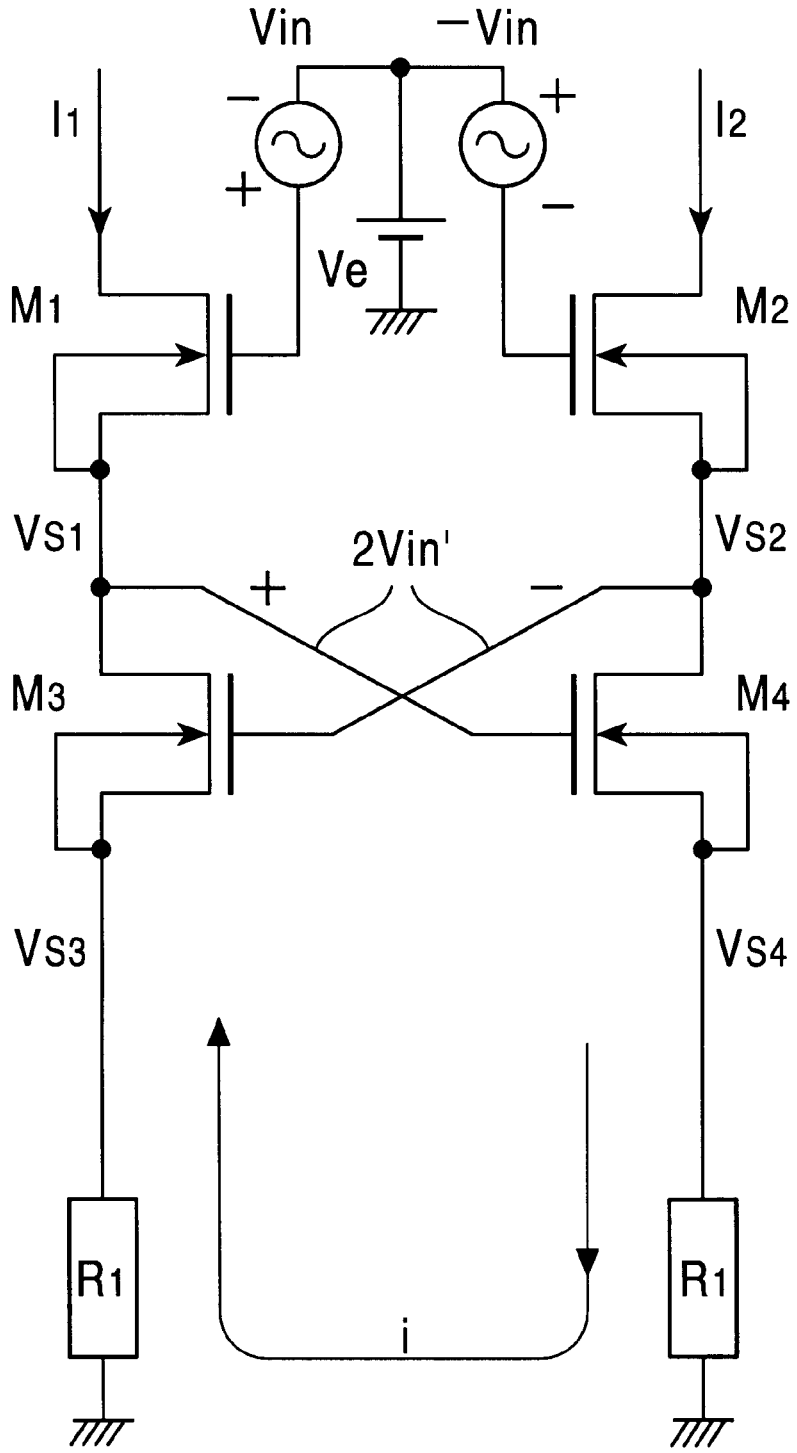
FIG. 2 is a circuit diagram illustrating another circuit configuration of the voltage/current converter circuit according to the embodiment of the present invention.

FIG. 2 is a circuit diagram illustrating another circuit configuration of the voltage/current converter circuit according to the embodiment of the present invention.

As shown in FIG. 2, the sources of the MOS transistors $M_3$ and $M_4$ may be each grounded via a resistor $R_1$. Incidentally, the resistance of the above resistor $R_1$ may be made to be half of that of the above resistor ($2R_1$).

The voltage/current converter circuit shown in FIG. 2 is an equivalent circuit of the voltage/current converter circuit shown in FIG. 1.

Incidentally, though the voltage/current converter circuit according to the present embodiment has been described as a configuration using only N-MOS transistors for the sake of ease of description, but it is self-apparent that the configuration may be made using only P-MOS transistors in the same way. From this perspective, the present circuit should be hereafter referred to as a Single-Channel MOS (S-MOS). Also, the assumption is made in the later-described Expressions used for clarifying the operating properties of the voltage/current converter circuit according to the present embodiment, that the currents flowing through the transistors $M_1$ and $M_3$ are equal in the event that there is no leakage of drain current in the saturation area of the MOS transistors to other than the MOS transistors, and that in this case Vgs which is the voltage between the gate and source is equal; this assumption is the same for the MOS transistors $M_2$ and $M_4$, as well.

Figure 3:
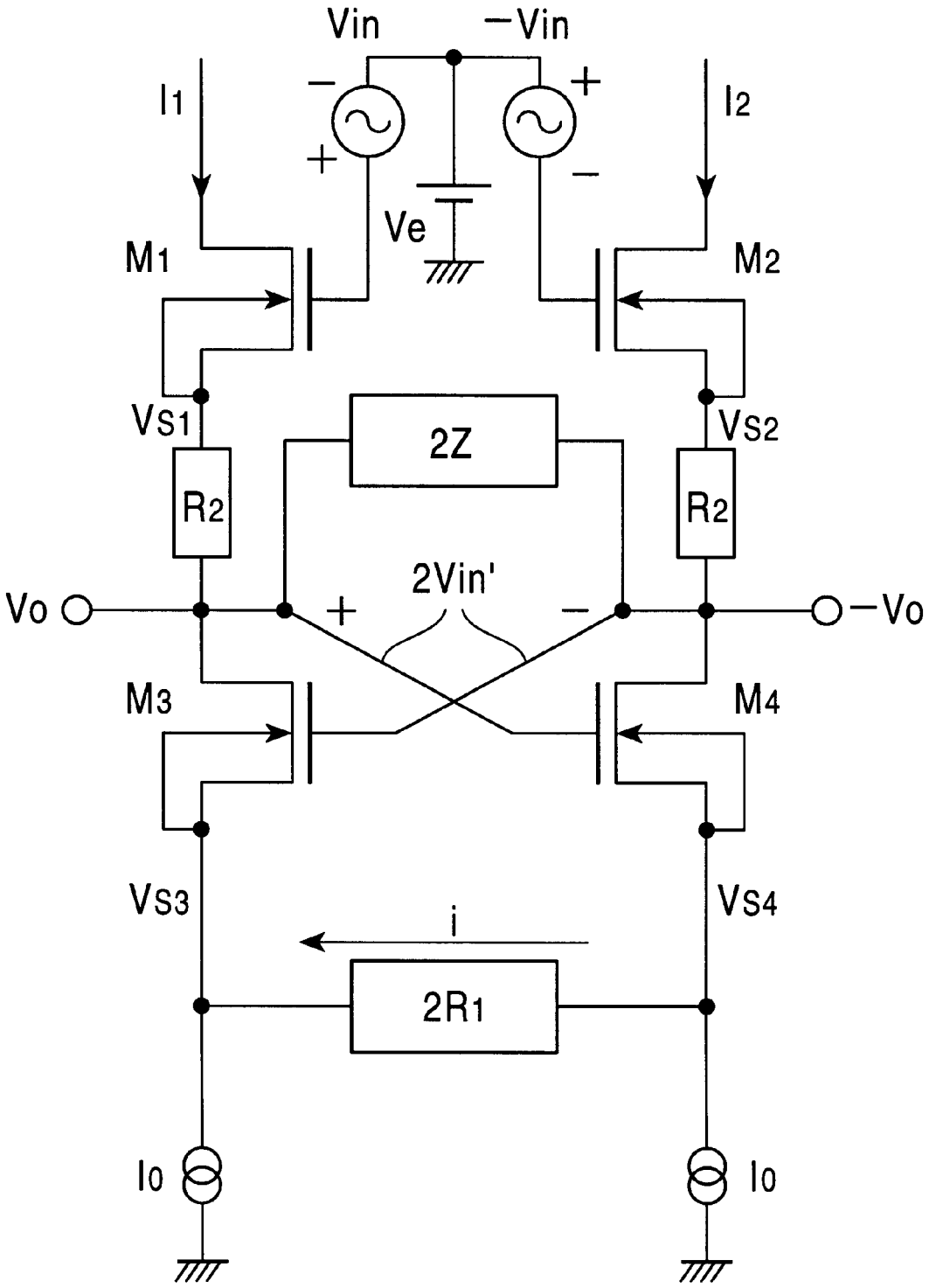
FIG. 3 is a circuit diagram illustrating the circuit configuration of a high-gain amplifying circuit containing the voltage/current converter circuit according to the embodiment of the present invention.

FIG. 3 is a circuit diagram illustrating the circuit configuration of a high-gain amplifying circuit containing the voltage/current converter circuit according to the embodiment of the present invention.

The high-gain amplifying circuit relating to the embodiment of the present invention contains a circuit configuration wherein a resistor $R_2$ is additionally inserted between the source of the MOS transistor $M_1$ and the drain of $M_3$ of the voltage/current converter circuit shown in FIG. 1 whereby linearity has been improved, and in the same way wherein a resistor $R_2$ is also additionally inserted between the source of the MOS transistor $M_2$ and the drain of $M_4$, and wherein impedance (2Z) is connected between the drains of the MOS transistors $M_3$ and $M_4$.

The gate return of the MOS transistors $M_3$ and $M_4$ and the source grounding is exactly the same as the voltage/current converter circuit shown in FIG. 1. With the rate of rise accompanied by increase in Vds following the pinch-off voltage of the drain current of all transistors represented by λ, and assuming that there is no leakage current to other than the MOS transistors, this leads to the currents flowing through the MOS transistors $M_1$ and $M_3$ being equal and in this case Vgs which is the voltage between the gate and source are equal, and further holding this the same for the MOS transistors $M_2$ and $M_4$ so as to sequentially go through expressions as described later, the final results for the output $V_0$ is the value shown in Expression (9).

At this time, with $(1/gm,+R_1)=K\times(1/gm_2+R_2)$, and in the event that $R_1$ and $R_2$, and $gm_1$ and $gm_2$ in the Expressions are infinitely close values, the K=1 holds, and the output thereof is the ratio between the impedance Z and $(1/gm_2+R_2)$, so it can be understood that in the event that the impedance Z is in an open state, this is a very great value. There is the need to set one condition here, which is that K>1. This is because in the event that the impedance (2Z) is capacitive, this can lead to latching up of the circuit. As described above, the output exhibits linear operating properties proportionate to the input, and can be realized by only S-MOS.

Figure 4:
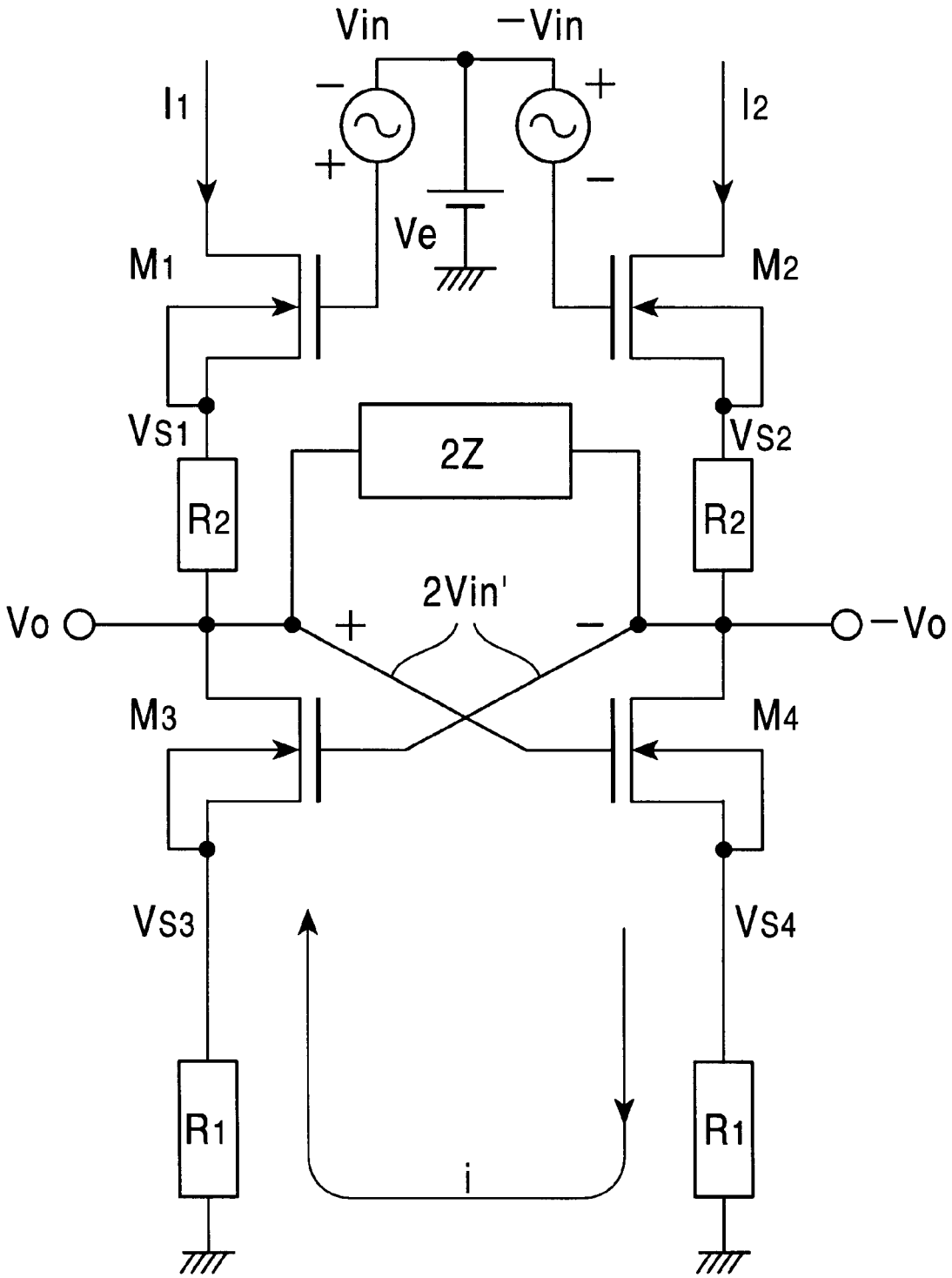
FIG. 4 also is a circuit diagram illustrating the circuit configuration of a high-gain amplifying circuit containing the voltage/current converter circuit according to the embodiment of the present invention.

FIG. 4 is a circuit diagram illustrating the circuit configuration of a high-gain amplifying circuit containing the voltage/current converter circuit according to the embodiment of the present invention.

As shown in FIG. 4, the sources of the MOS transistors $M_3$ and $M_4$ may be each grounded via a resistor $R_1$. Incidentally, the resistance of the above resistor $R_1$ may be made to be half of that of the above resistor ($2R_1$).

The high-gain amplifying circuit shown in FIG. 4 is an equivalent circuit of the high-gain amplifying circuit shown in FIG. 3.

Incidentally, though the high-gain amplifying circuit according to the present embodiment has been described as a configuration using only N-MOS transistors for the sake of ease of description, but it is self-apparent that the configuration may be made using only P-MOS transistors in the same way.

(Description relating to the Expressions)

The operating properties of the voltage/current converter circuit according to the present embodiment will be described with reference to the following series of expressions.

Figure 5:
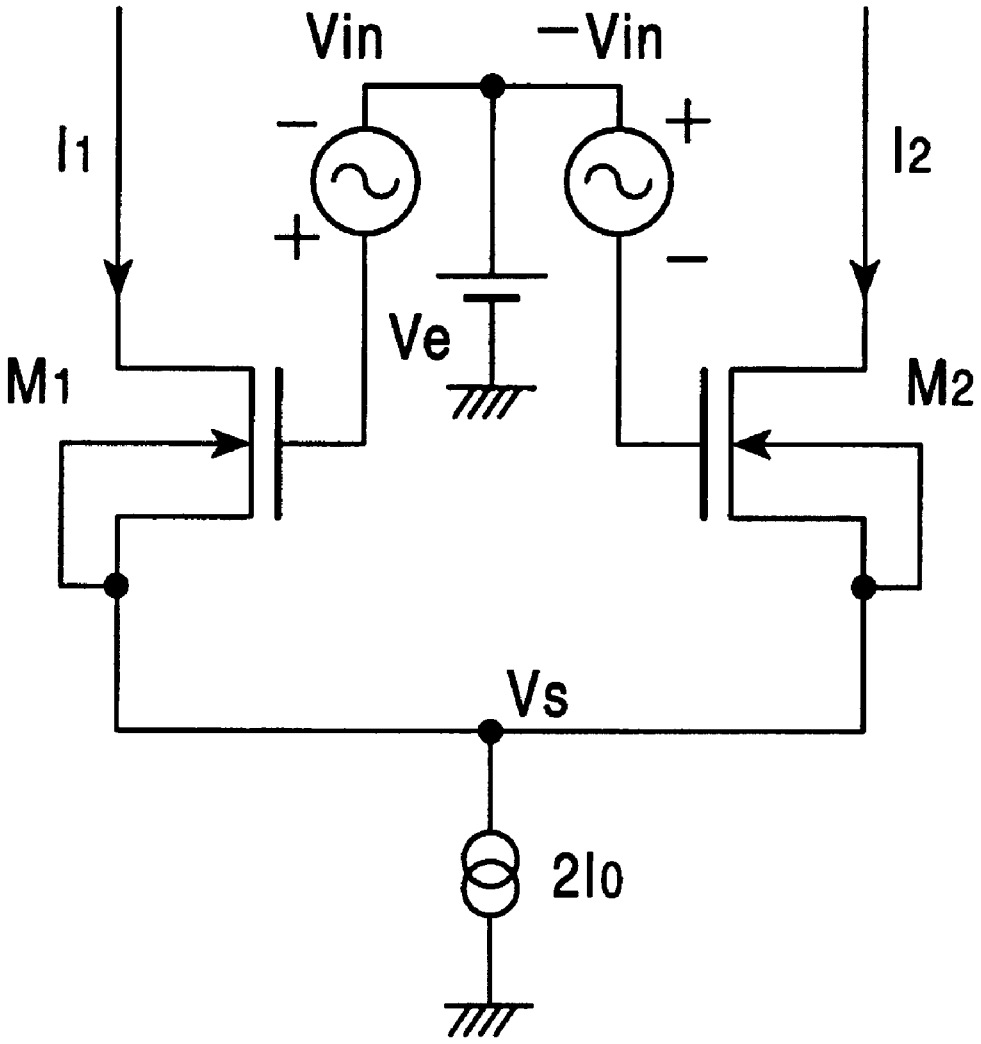
FIG. 5 (PRIOR ART)
FIG. 5 is a circuit diagram illustrating the circuit configuration of a conventional voltage/current converter circuit containing a MOS transistor differential pair circuit.

First, with regard to the conventional voltage/current converter circuit containing a MOS differential pair circuit shown in FIG. 5, with Id as the drain current, M as the drain current coefficient, and λ as the early coefficient of the drain current at the saturation area, the following Expression (1) holds.

Expression (1)

$$I_1d=I_0+M/2\times\sqrt{\{2I_0\times\lambda/M-(Vin\times\lambda/2)^2\}}\times Vin,\ I_2=I_0-M/2\times\sqrt{\{2I_0\times X\lambda/M-(Vin\times\lambda/2)^2\}}\times Vin \quad (1)$$

The general Expression for the drain current Id in the saturation area can be obtained by the following Expression (2).

Expression (2)

$$Id=M/2\times(Vgs-Vth)^2\times\lambda \quad (2)$$

Now, calculating $(I_1-I_2)$ with X=Ve+Vin, Y=Ve−Vin, with Vs as the common source potential, with $I_1$, as $_I=M/2\times(Ve+Vin-Vs-Vth)^2\times\lambda$, with $I_2$ as $I_2=M/2\times(Ve-Vin-Vs-Vth)^2\times\lambda$, and using the following Expression (3), the following Expression (4) is obtained.

Expression (3)

$$X^2-y^2=(X+Y)\ (X-Y) \quad (3)$$

Expression (4)

$$(I_1-I^2)=2M\times\lambda\times(Ve-Vs-Vth)\times Vin \quad (4)$$

Next, with the voltage/current converter circuit according to the present embodiment shown in FIG. 1, the currents flowing through $M_1$ and $M_3$ are the same, which is represented by $I^1$, and the currents flowing through $M_2$ and $M_4$ are the same, which is represented by $I_2$.

Further, the G-S voltage of the transistor $M_4$ is represented as $Vgs_4$, and the G-S voltage of the transistor $M_3$ as $Vgs_3$, which yields $2Vin'=Vgs_4+i\times 2R_1-Vgs_3$.

Thus, from the above Expression (2), $Vgs_4=\sqrt{(2I_2/M/\lambda)}+Vth$ and $Vgs_3=\sqrt{(2I/M/\lambda)}\cdot Vth$, so the following Expression (5) holds.

Expression (5)

$$2Vin'=\sqrt{(2I_2/M/\lambda)}+Vth+i\times 2R_1-\sqrt{(2I_1/M/\lambda)}+Vth=\sqrt{(2/M/\lambda)}\times(\sqrt{I_2}-\sqrt{I_1})+i\times 2R_1 \quad (5)$$

Further, with the voltage/current converter circuit according to that shown in FIG. 1, the G-S voltage of the transistor $M_1$ is represented as $Vgs_1$, and the G-S voltage of the transistor $M_2$ as $Vgs_2$, which yields the following Expression (6).

Expression (6)

$$2Vin=vgs_1+2Vin'-Vgs_2=\sqrt{(2I_1/M/\lambda)}+Vth+2Vin_1-\sqrt{(2I_2/M/\lambda)}-Vth=\sqrt{(2I_1/M/\lambda)}+2Vin'-\sqrt{(2I_2/M/\lambda)}=\sqrt{(2/M/\lambda)}\times(\sqrt{I_2}-\sqrt{I_1})+2Vin' \quad (6)$$

The above Expressions (5) and (6) yield $2Vin=-2Vin'+i\times 2R_1+2Vin'$.

Accordingly, the following Expression (7) holds.

Expression (7)

$$Vin=i\times R_1,$$

$$i=Vin/R_1 \quad (7)$$

Hence, since $I_1=I_0-i$ and $I_2=I_0+i$, the following Expression (8) is obtained.

Expression (8)

$$I_1=I_0-Vin/R_1,$$

$$I_2=I_0+Vin/R_1 \quad (8)$$

With the high-gain amplifying circuit shown in FIG. 3, $(Vin-V_0)/(1/gm_2+R_2)=V_0/Z-V_0/(1/gm_1+R_1)$ holds.

Hence, finally, the following Expression (9) is obtained.

Expression (9)

$$V_0/Vin=Z/[1/gm+R_2+Z(1-1/K)] \quad (9)$$

wherein the conductance of the transistors $M_1$ and $M_3$ are equally $gm_2$, the conductance of the transistors $M_2$ and $M_4$ are equally $gm_1$, $gm=gm_1=gm_2$, $R_1=R_2=R$, and further wherein K is defined by $1/gm_1+R_1=K\times(1/gm_2+R_2)$ Accordingly, from the expression (9), it can be understood that the condition for preventing latching up of the circuit is K>1.

According to the present invention described above, high gain and improvement of linearity which had been realized by combining the two channels of P-MOS and N-MOS transistors can be realized with a Single-Channel, and there is no need to take the irregularities between channels (which is the irregularities most difficult to handle of all transistor property irregularities) into consideration, so a high-gain amplifying circuit having differential input and differential output can be realized, and there is no need to conceive means to maintain the balance of the circuit using feedback as with conventional arrangements.

Also, the invention is of a 1-channel configuration only, of N-channel or P-channel only, and thus is suitable for operating in low power source voltage environments.

Also, employing the method of mutually canceling out current conductance enables the gain of the amplifier to be markedly improved over conventional arrangements.

Also, the target gain can be obtained with fewer elements and fewer amp tiers as compared to conventional arrangements, so circuit capabilities such as SN ratio greatly improve, along with reduction in power consumption.

Also, configuration of the circuit with differential output of differential input even further markedly improves circuit capabilities such as SN ratio.

The above advantages collectively improve product capabilities, reduce manufacturing costs, reduce circuit board area, and so forth. Also, development of a conventionally-unachievable high-gain amplifier broadens the application range thereof, and thus can be used, for example, limiter amps, PLL, AM-DET, FM-DET, filters, AGC-amps, and so forth.

What is claimed is:

1. A voltage/current converter circuit comprising:

a first MOS transistor differential pair circuit;

a second MOS transistor differential pair circuit wherein the drain terminal thereof are connected to each of the source terminals of said first MOS transistor differential pair circuit; and a resistor element connected between the sources of said second MOS transistor differential pair circuit;

wherein the gate terminals of said first MOS transistor differential pair circuit serve as input voltage terminals and the drain terminals serve as output current terminals;

and wherein the gates of the two mutually complementary MOS transistors of said second MOS transistor differential pair circuit are mutually connected to the drains of the MOS transistors of the other side, and the sources of said two MOS transistors are each grounded via an electric current source.

2. A voltage/current converter circuit comprising:

a first MOS transistor differential pair circuit; and a second MOS transistor differential pair circuit wherein the drain terminal thereof are connected to each of the source terminals of said first MOS transistor differential pair circuit; and wherein the gate terminals of said first MOS transistor differential pair circuit serve as input voltage terminals and the drain terminals serve as output current terminals;

and wherein the gates of the two mutually complementary MOS transistors of said second MOS transistor differential pair circuit are mutually connected to the drains of the MOS transistors of the other side, and the sources of said two MOS transistors are each grounded via a resistor element.

3. A high-gain amplifying circuit comprising:

a first MOS transistor differential pair circuit;

a second MOS transistor differential pair circuit wherein the drain terminal thereof are connected to each of the source terminals of said first MOS transistor differential pair circuit via first resistor elements;

second resistor elements connected between the sources of said second MOS transistor differential pair circuit; and impedance elements connected between the drains of said second MOS transistor differential pair circuit;

wherein the gate terminals of said first MOS transistor differential pair circuit serve as input voltage terminals and the drain terminals serve as output current terminals;

and wherein the gates of the two mutually complementary MOS transistors of said second MOS transistor differential pair circuit are mutually connected to the drains of the MOS transistors of the other side, and the sources of said two MOS transistors are each grounded via an electric current source.

4. A high-gain amplifying circuit comprising: a first MOS transistor differential pair circuit;

a second MOS transistor differential pair circuit wherein the drain terminal thereof are connected to each of the source terminals of said first MOS transistor differential pair circuit via first resistor elements; and impedance elements connected between the drains of said second MOS transistor differential pair circuit;

wherein the gate terminals of said first MOS transistor differential pair circuit serve as input voltage terminals and the drain terminals serve as output current terminals;

and wherein the gates of the two mutually complementary MOS transistors of said second MOS transistor differential pair circuit are mutually connected to the drains of the MOS transistors of the other side, and the sources of said two MOS transistors are each grounded via second resistor elements.

* * * * *